US005317940A

United States Patent [19]

Shun'ko

[11] Patent Number: 5,317,940

[45] Date of Patent: Jun. 7, 1994

[54] SCREWDRIVER BLADE

[76] Inventor: Evgeny V. Shun'ko, 1909 Meadville St., Pittsburgh, Pa. 15214

[21] Appl. No.: 935,001

[22] Filed: Aug. 25, 1992

[51] Int. Cl.[5] ..... B25B 15/00

[52] U.S. Cl. ..... 81/436

[58] Field of Search ..... 81/436, 441, 442, 448, 81/449, 461

[56] References Cited

U.S. PATENT DOCUMENTS 1,899,489 2/1933 Wickbergh ..... 81/441

4,625,598 12/1986 Wolfram ..... 81/436

*Primary Examiner*—D. S. Meislin

*Attorney, Agent, or Firm*—William J. Ruano

[57] ABSTRACT

The present invention pertains to a screwdriver blade. The screwdriver blade comprises a shank having a central axis and a tip portion which extends from the shank. The tip portion has a pair of opposing concave driving faces and a concave terminal end surface. The concave driving faces are torsidal having a first radius $R_1$ disposed in a plane which is parallel to the central axis. The first radius $R_1$ has a center disposed at a distance x from a side edge of the concave terminal end surface. The concave driving faces have a second radius $R_2$ disposed in a plane perpendicular to the central axis. The terminal end surface is cylindrical and has a third radius $R_3$ which is disposed in a plane perpendicular to the plane through first radius $R_1$. The tip portion has a width b and a maximum thickness c and preferably, $0.2b \leqq x \leqq 0.5b$, $02b \leqq R_1 \leqq b$, $R_2 \leqq Kb^2/c$ where K is a constant and $0.5R_2 \leqq R_3 \leqq 2R_2$ and the angle $\alpha$ between a line tangent to $R_1$ at the maximum thickness c and the central axis is between 15° and 45°. In one embodiment, $x=0.5b$, $R_1=b$, $R_2=0.32b^2/c$ and $R_3=R_2$ and $\alpha=30°$.

3 Claims, 3 Drawing Sheets

SCREWDRIVER BLADE

FIELD OF THE INVENTION

The present invention is related in general to screwdrivers. More specifically, the present invention is related to a screwdriver blade having a tip shaped to prevent backfeed which causes the tip's destruction.

BACKGROUND OF THE INVENTION

It is known that during the turning of a screw with a screwdriver, the tip of an ordinary screwdriver with a planar blade is twisted due to the material of the tip undergoing elastic deformation. This twisting causes the tip to assume a spiral shape that results in a longitudinal force, along the screwdriver axis, pulling the screwdriver tip out from the screw spline. As a result, the edges of both operating sides of the screwdriver are rubbed out increasing the pulling effects. This destroys the screwdriver tip as well as the screw spline. This backfeed effect is illustrated in FIGS. 5*a* and 5*b*.

The present invention prevents this backfeed effect by providing a screwdriver tip which is specifically shaped such that when it is deformed during turning, the tip assumes a flat shape against the screw spline. In this manner, the screwdriver tip cannot push away from the screw spline to cause backfeed.

SUMMARY OF THE INVENTION

The present invention pertains to a screwdriver blade. The screwdriver blade comprises a shank having a central axis and a tip portion which extends from the shank. The tip portion has a pair of opposing concave driving faces and a concave terminal end surface. The concave driving faces are torsidal having a first radius $R_1$ disposed in a plane which is parallel to the central axis. The first radius $R_1$ has a center disposed at a distance x from a side edge of the concave terminal end surface. The concave driving faces have a second radius $R_2$ disposed in a plane perpendicular to the central axis. The terminal end surface is cylindrical and has a third radius $R_3$ which is disposed in a plane perpendicular to the plane through first radius $R_1$.

The tip portion has a width b and a maximum thickness c and preferably, $0.2b \leqq x \leqq 0.5b$, $0.2b \leqq R_1 \leqq 2b$, $R_2 = Kb^2/c$ where K is a constant and $0.5R_2 \leqq R_3 \leqq 0.2R_2$ and the angle $\alpha$ between a line tangent to $R_1$ at the maximum thickness c and the central axis is between 15° and 45° . In one embodiment, $x = 0.5b$, $R_1 = b$, $R_2 = 0.326^2/c$ and $R_3 = R_2$ and $\alpha = 30°$.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
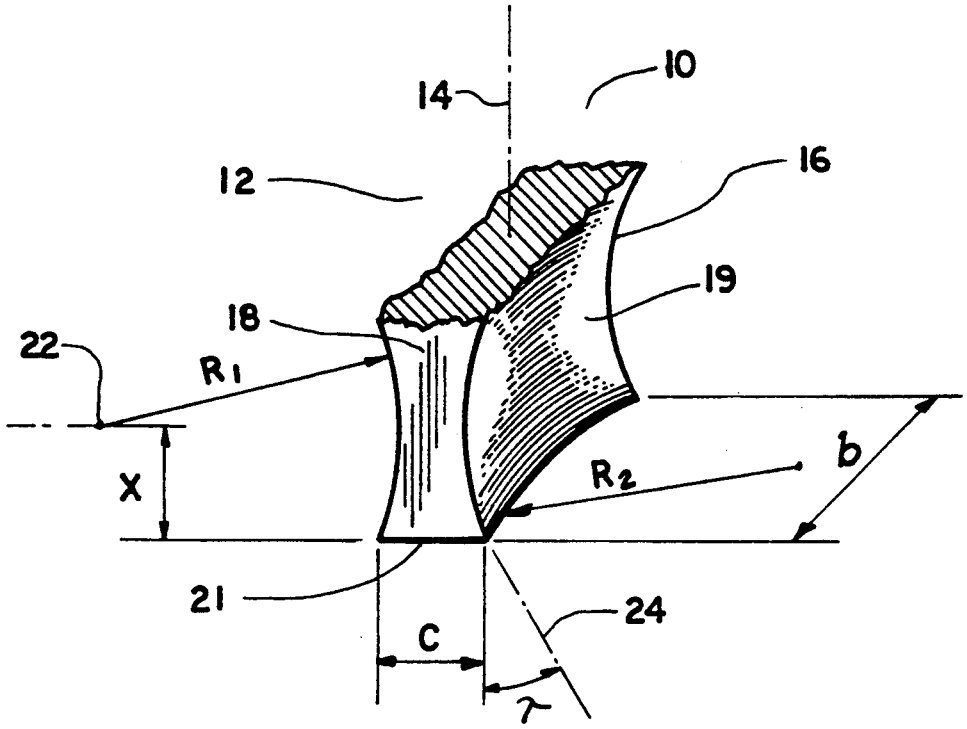
FIG. 1 is a schematic representation showing a perspective view of the screwdriver blade.
Figure 2:
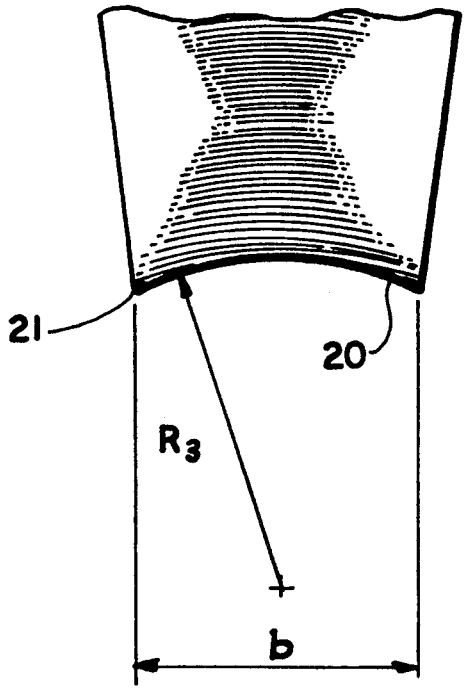
FIG. 2 is a schematic representation showing the concave terminal end surface of the screwdriver blade.

Referring now to the drawings wherein like reference numerals refer to similar or identical parts throughout the several views, and more specifically to FIGS. 1 and 2 thereof, there is shown a screwdriver blade 10. The screwdriver blade 10 comprises a shank 12 having a central axis 14 and a tip portion 16 which extends from the shank 12. The tip portion 16 has a pair of opposing concave driving faces 18 and a concave terminal end surface 20. The concave driving faces 18 are torsidal having a first radius $R_1$ disposed in a plane which is parallel to the central axis 14. The first radius $R_1$ has a center 22 disposed at a distance x from a side edge 21 of the concave terminal end surface 20. The concave driving faces 18 have a second radius $R_2$ disposed in a plane perpendicular to the central axis 14. The terminal end surface 20 is cylindrical and has a third radius $R_3$ which is disposed in a plane perpendicular to the plane through first radius $R_1$.

In a preferred embodiment, the tip portion 16 has a width b at the terminal end surface 20 and a maximum thickness c and:

$$.2b \leqq x \leqq .5b$$

$$.2b \leqq R_1 \leqq 2b$$

$$R_2 = Kb^2/c, \text{ where } K \text{ is a constant}$$

$$.5R_2 \leqq R_3 \leqq 2R_2$$

Preferably, the angle between a line 24 tangent to a concave driving surface 18 at the maximum thickness c and a line at the maximum thickness c parallel to the central axis is between 15° and 45° and preferably is 30°.

It should be appreciated that the invention is not limited to the previously cited dimensional ranges. Other values can be used depending on the specific operating parameters of the screwdriver blade 10, such as applied torque and the elasticity of the blade 10. What is important is that the initial dimensions of the screwdriver blade 12 deform in a shape, during applied torque, which provides a flush face against either side of the screw splice 34 for turning the screw. Thus, effectively, the screwdriver blade 10 of the present invention twists into shape rather than out of shape.

The previously described shape of the tip portion 16 ensures that the driving faces 18 assume a flat shape against the screw spline when deformed during twisting due to elastic deformation. In this manner, the driving faces 18 cannot push away from or dig into the screw spline to cause backfeed.

Figure 3:
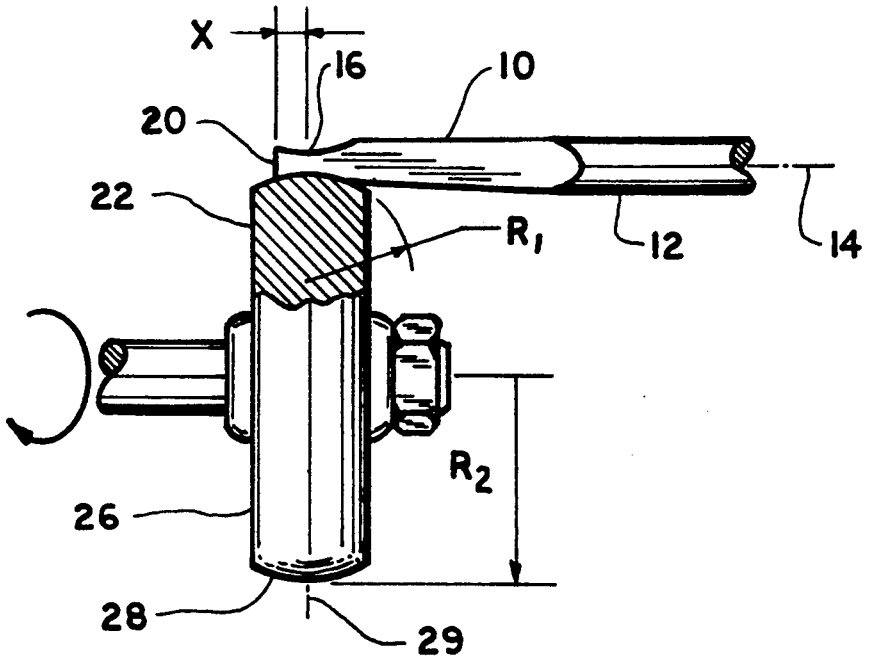
FIG. 3 is a schematic representation showing a preferred manner of forming the tip portion of the screwdriver blade.

In a specific example of the operation of the invention, and as shown in FIG. 3, the tip portion 16 of the screwdriver blade 10 is formed by grinding it against a spinning abrasive disc 26 having a radius equal to $R_2$ and a curved outer edge 28 having a radius equal to $R_1$. The apex 29 of the curved outer edge 28, which corresponds to the center 22 of $R_1$, is positioned at the distance x from the concave terminal end 20. Further:

$$x = .5b$$
$$R_1 = b$$
$$R_2 = .32b^2/c$$
$$R_3 = R_2$$

Figure 4:
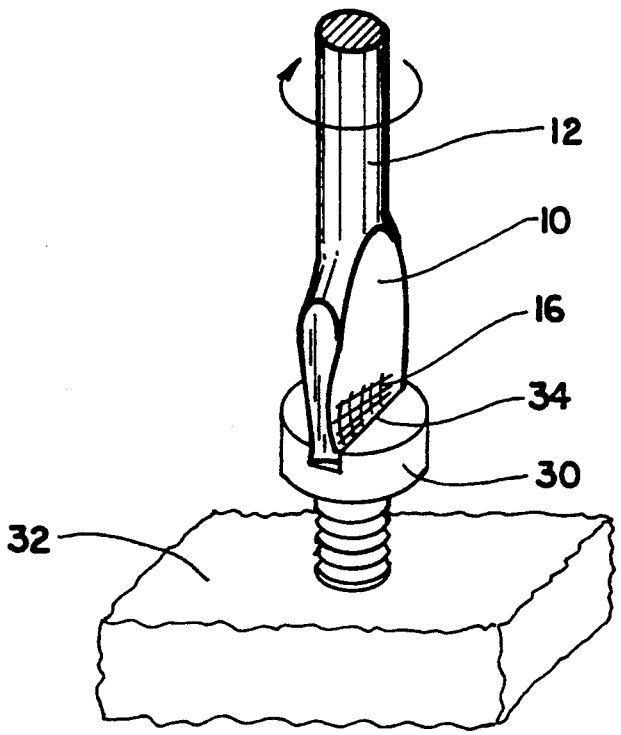
FIG. 4 is a schematic representation showing the screwdriver blade in engagement with a screw.
Figure 5A:
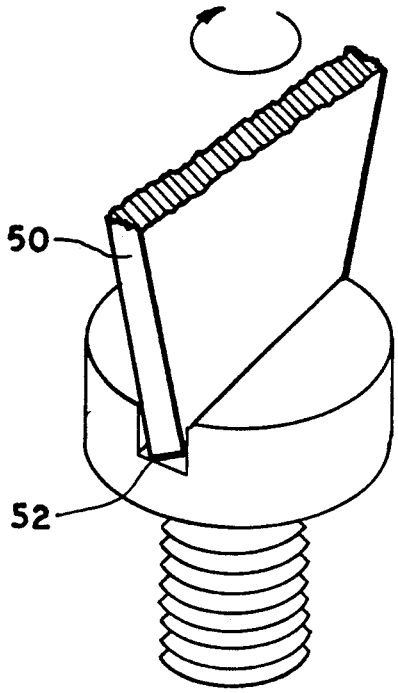
PRIOR ART FIG. 5A
FIGS. 5*a* and 5*b* are schematic representations showing a typical prior art screwdriver blade in engagement with a screw.
Figure 5B:
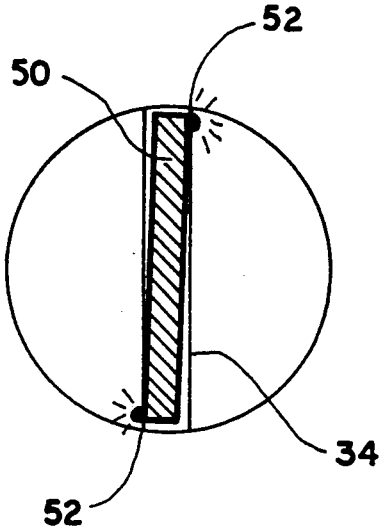
PRIOR ART FIG. 5B
Figure 6A:
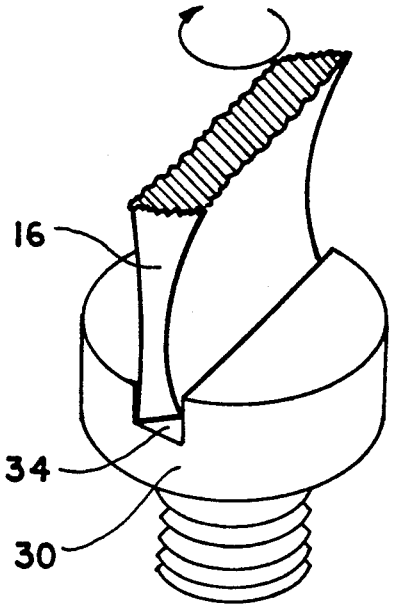
FIGS. 6*a*, 6*b* and 6*c* are schematic representations showing the screwdriver blade of the present invention in engagement with a screw.
Figure 6B:
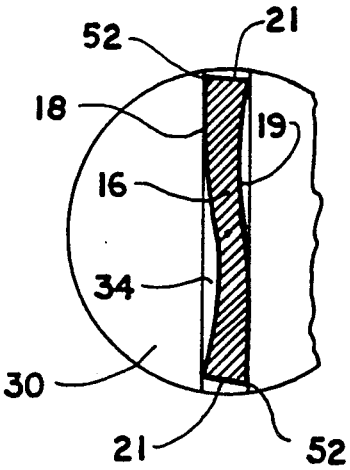
Figure 6C:
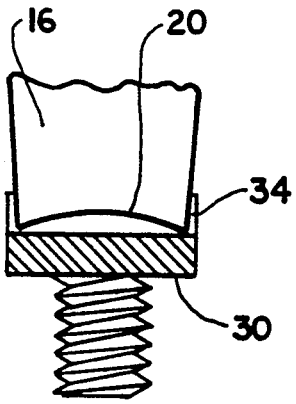

As shown in FIG. 4, the screwdriver blade 10 is steel and is used to screw a threaded fastener 30, such as a screw, into a member 32. The tip portion 16 is inserted into the spline 34 of the threaded fastener 30. The shank 12 is then turned, such as with the aid of a handle (not shown), to drive the screw 30 into the member 32. During turning, as shown in FIG. *6a*, the tip portion 16 is twisted and deformed. The initial concave shape of the driving surfaces 18 and the terminal end surface 20 are flattened out due to elastic deformation as the screwdriver blade 10 is twisted. As specifically shown in FIG. *6b*, the driving surfaces 18, 19 which were concave, are in flush contact with the flat surface of the screw spline 34 at either side 21 of the tip portion 16. Thus, the corners 52 at the intersection of the driving surfaces 18, 19 and the sides 21, cannot dig into the screw spline 34 or push away therefrom. Further, as shown in FIG. *6c*, the terminal end surface 20 also flattens out due to the twisting of the screwdriver blade 10. Since the driving surfaces 18 are flush with the edges of the screw spline 34 during turning, there can be no force, or backfeed, pushing the tip portion from the screw spline. In this manner, the tip portion 16 and screw spline 34 are not stripped and the user does not have to resist the screwdriver blade 10 from pushing away from the threaded fastener 30. This stands in direct contrast to a typical screwdriver 50 which, when twisted, as shown in FIGS. *5a* and *5b*, forms a spiral shape which causes the corners 52 of the blade to dig into and push away from the screw spline 34.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A screwdriver blade comprising:

a shank having a central axis; and a tip portion extending from said shank, said tip portion having a pair of opposing concave driving faces and a concave terminal end surface, said concave driving faces being of torsidal shape and having a first radius $R_1$ disposed in a plane parallel to said central axis, said first radius $R_1$ having a center disposed a distance x from a side edge of the concave terminal end surface, said concave driving faces having a second radius $R_2$ disposed in a plane perpendicular to said central axis, said terminal end surface being of cylindrical shape and having a third radius $R_3$ disposed in a plane perpendicular to the plane through $R_1$.

2. A screwdriver blade as described in claim 1 wherein said tip portion has a width b at the terminal end surface and a maximum thickness c; and $0.2b \leqq x \leqq 0.5b$, $0.2b \leqq R_1 \leqq b$, $R_2 = 0.32b^2/c$ and $0.5R_2 \leqq R_3 \leqq 2R_2$.

3. A screwdriver blade as described in claim 2 wherein $x = 0.5b$, $R_1 = b$, and $R_3 = R_2$.

* * * * *

UNITED STATES PATENT AND TRADEMARK OFFICE

CERTIFICATE OF CORRECTION

PATENT NO. : 5,317,940

DATED : June 7, 1994

INVENTOR(S) : Evgeny V. Shun'ko

It is certified that error appears in the above-indentified patent and that said Letters Patent is hereby corrected as shown below:

On title page, item [57] Abstract, line 6, "torsidal" should read --toroidal--.

Column 1, line 35, "torsidal" should read --toroidal--

Column 2, line 17, "torsidal" should read --toroidal--

Column 4, line 17, "torsidal" should read --toroidal--.

Signed and Sealed this

Eighteenth Day of October, 1994

*Attest:*

Bruce Lehman

BRUCE LEHMAN

*Attesting Officer*

*Commissioner of Patents and Trademarks*